US009162123B2

(12) United States Patent
Enright

(10) Patent No.: US 9,162,123 B2
(45) Date of Patent: Oct. 20, 2015

(54) GOLF BAG ACCESSORY FOR INDICATING REMOVAL OF A CLUB FROM THE BAG

(71) Applicant: Hugh Kevin Enright, Forked River, NJ (US)

(72) Inventor: Hugh Kevin Enright, Forked River, NJ (US)

( * ) Notice: Subject to any disclaimer, the term of this patent is extended or adjusted under 35 U.S.C. 154(b) by 344 days.

(21) Appl. No.: 13/860,078

(22) Filed: Apr. 10, 2013

(65) Prior Publication Data

US 2014/0305365 A1 Oct. 16, 2014

(51) Int. Cl.
*A63B 55/00* (2015.01)

(52) U.S. Cl.
CPC ..... *A63B 55/008* (2013.01); *A63B 2055/001* (2013.01); *A63B 2209/00* (2013.01)

(58) Field of Classification Search
CPC ..... A63B 55/00; A63B 55/001; A63B 55/002
USPC ..... 116/200; 206/315.2, 315.3, 315.6; 277/634, 636; 473/407, 409
See application file for complete search history.

(56) References Cited

U.S. PATENT DOCUMENTS

| | | | | |
|---|---|---|---|---|
| 4,664,382 | A * | 5/1987 | Palmer et al. | 473/288 |
| 4,746,014 | A * | 5/1988 | Very | 206/315.6 |
| 4,819,919 | A * | 4/1989 | Taylor | 267/64.13 |
| 4,944,396 | A * | 7/1990 | Larkin | 206/315.6 |
| 5,094,345 | A * | 3/1992 | Yonnetti | 206/315.2 |
| 5,318,480 | A * | 6/1994 | Essi et al. | 464/175 |
| 5,950,823 | A * | 9/1999 | Flis | 206/315.2 |
| 6,102,202 | A * | 8/2000 | Jones | 206/315.6 |
| 6,209,721 | B1 * | 4/2001 | Sharpe et al. | 206/315.6 |
| 6,626,293 | B2 * | 9/2003 | St. Jeor | 206/315.6 |
| 6,929,124 | B2 * | 8/2005 | Kawasaki | 206/315.2 |
| 2005/0066876 | A1 * | 3/2005 | Ritchey | 116/201 |
| 2012/0248712 | A1 * | 10/2012 | Mitsui et al. | 277/596 |

* cited by examiner

*Primary Examiner* — R. A. Smith
(74) *Attorney, Agent, or Firm* — Stuart M. Goldstein

(57) ABSTRACT

A golf bag accessory, for indicating the removal of a golf club from a golf bag, has a base member consisting of supporting ring elements. An indicator member with an open top is made of two layers of low friction material surrounding a rubber boot element. The two material layers and the boot element are connected between the ring members. The indicator member extends down from the base member to circumscribe a golf club positioned within the golf bag. Upon removal of the golf club from the golf bag, the indicator member is drawn upwards, ultimately extending up from the base member and out of the golf bag to provide notice to the golfer that a club has been removed and needs to be replaced.

4 Claims, 5 Drawing Sheets

GOLF BAG ACCESSORY FOR INDICATING REMOVAL OF A CLUB FROM THE BAG

BACKGROUND OF THE INVENTION

During a round of golf, a player will certainly encounter more than one occasion when he or she has played the ball close to or just off the green. In these cases, the golfer will routinely withdraw both the wedge and putter from his or her golf bag at the same time in order to finish the hole, leaving the bag behind. This saves time and the extra steps otherwise required to remove the wedge, hit the ball, replace the wedge, retrieve the putter and then walk back to the green to play the ball. Once on the green, the golfer who is carrying the two clubs, will lay the wedge on the ground, pick up the putter, and hole out. However, all too often the golfer will replace the putter in the bag, but forget about the wedge on the ground, as he or she moves on to the next hole. The result, at the very least, is the frustrating need to return to the hole, once the golfer finally realizes the omission. At worse, an expensive golf club is never located and is lost.

SUMMARY OF THE INVENTION

It is thus the object of the present invention to provide a golf bag accessory for easily and effectively indicating the removal of a golf club from a golf bag.

It is a further object of the present invention which provides an accessory which is lightweight, portable, easily attached to virtually any golf bag, does not require costly electronics, has few component parts, is economical to manufacture, and is 100% effective in providing notice to the golfer that one of his clubs is missing from the bag.

These and other objects are accomplished by the present invention, a golf bag accessory for indicating removal of a golf club from a golf bag comprising a base member consisting of supporting ring elements. An indicator member with an open top is made of two layers of low friction material surrounding a rubber boot element. The two material layers and the boot element are connected between the ring members. The indicator member extends down from the base member to circumscribe a golf club positioned within the golf bag. Upon removal of the golf club from the golf bag, the indicator member is drawn upwards, ultimately extending up from the base member and out of the golf bag to provide notice to the golfer that a club has been removed and needs to be replaced.

The novel features which are considered as characteristic of the invention are forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
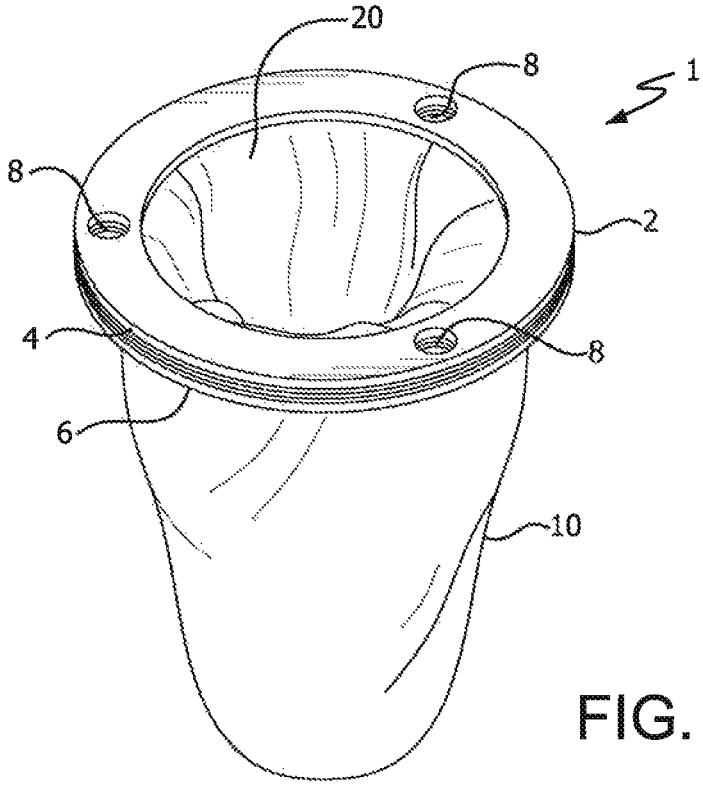
FIG. 1 is an isometric view of the golf bag accessory of the present invention.
Figure 2:
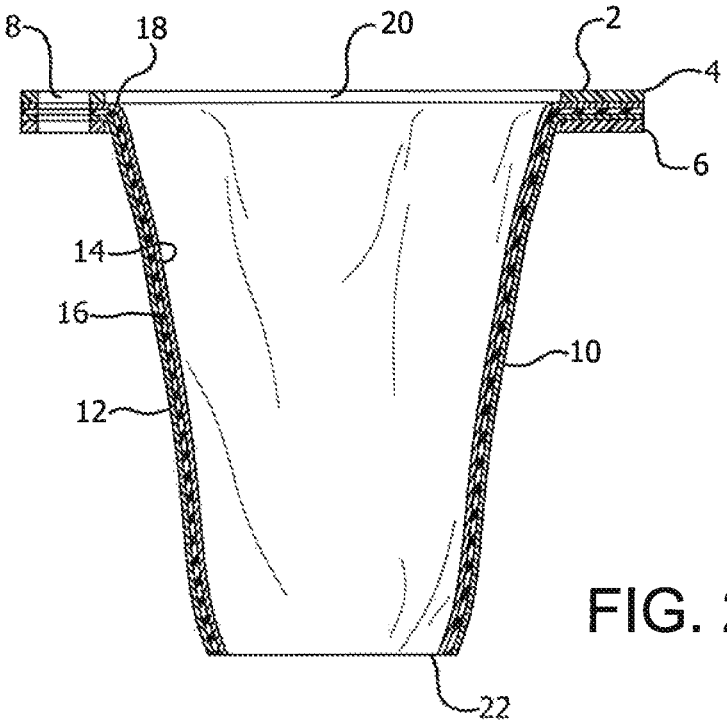
FIG. 2 is a cross-section view of the golf bag accessory of the present invention.

Golf bag accessory 1 of the present invention comprises base member 2 and indicator member 10 extending from the base member. Base member 2 comprises top ring element 4 and bottom ring element 6. Small holes 8 extend through the ring elements.

Indicator member 10 has a tapered, conical frustum shape. It comprises two layers 12 and 14 of flexible, low-friction synthetic material. A thin, flexible rubber or equivalent material boot element 16 is located in-between layers 12 and 14.

Figure 3:
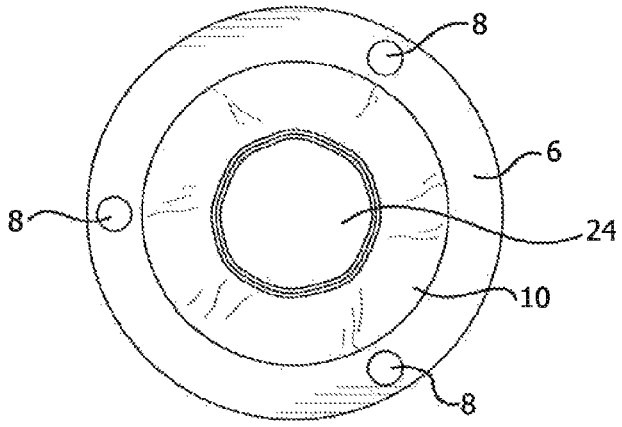
FIG. 3 is a bottom view of the golf bag accessory of the present invention.
Figure 4:
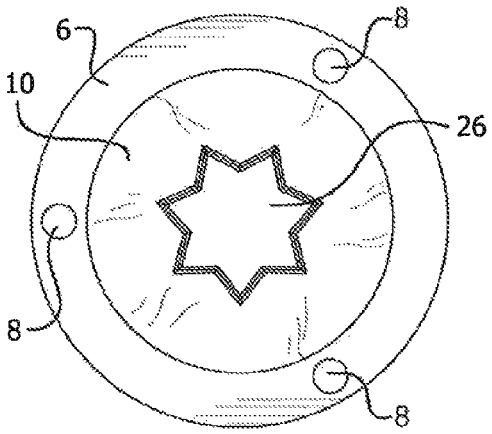
FIG. 4 is another embodiment of the bottom view of the golf bag accessory of the present invention.
Figure 5:
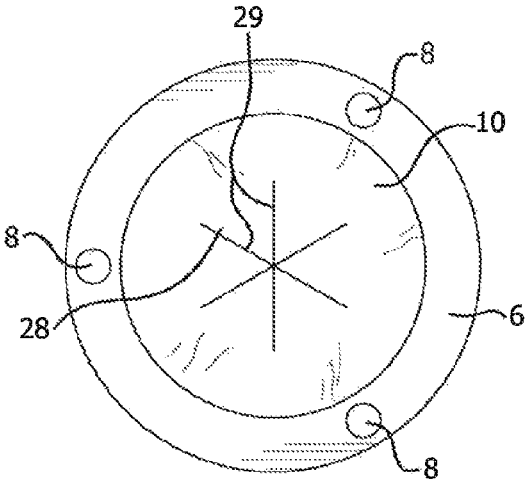
FIG. 5 is a third embodiment of the bottom view of the golf bag accessory of the present invention.
Figure 6:
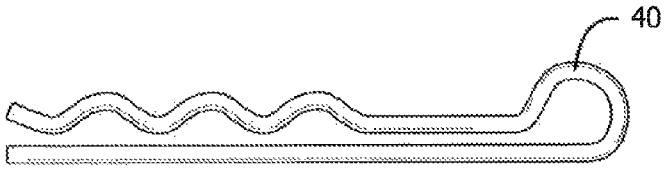
FIG. 6 shows the bias clip utilized with the present invention.

Layers 12 and 14 and boot element 16 of indicator member 10 are secured between ring elements 4 and 6 at one end 18 of the indicator member. Indicator member has opening 20 located at end 18. Opposite end 22 of indicator member 10 comprises opening 24. See FIG. 3. Alternatively, opposite end 22 of indicator member 10 can have opening 26 with serrated edges, FIG. 4, or comprise pie slice shaped segments 28 with cuts 29 therebetween, FIG. 5.

Figure 7:
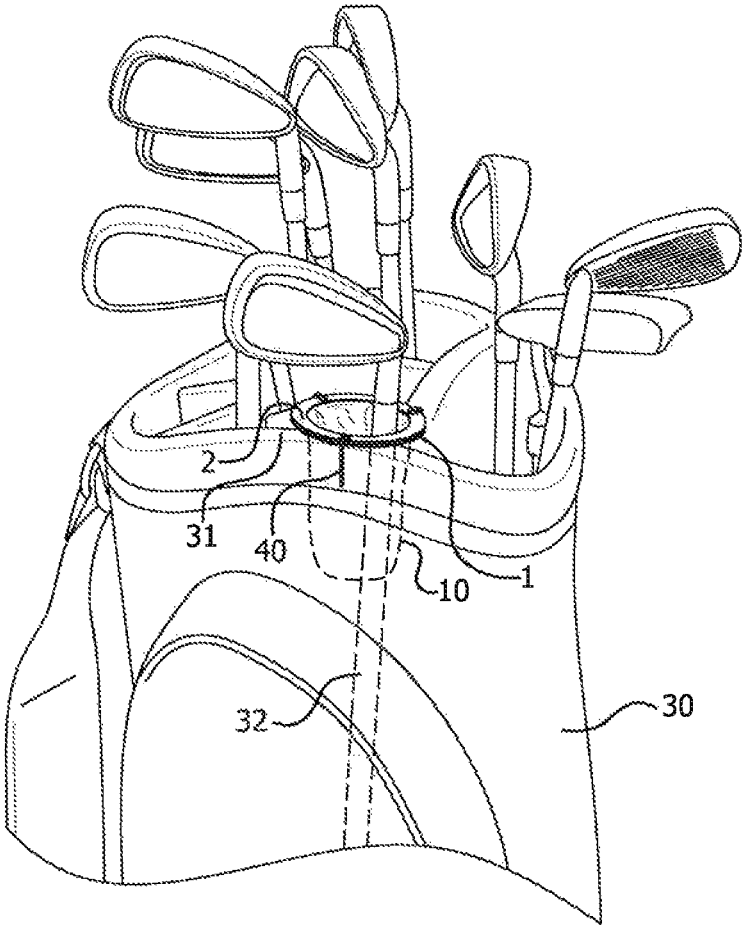
FIG. 7 shows a golf club being positioned within a golf bag and within the golf accessory of the present invention.

In use, accessory 1 is positioned such that base member 2 is located on a top surface 31 of golf bag 30, e.g. on the edge or on golf club separator ribs of the bag. Attachment elements, such as biased clips 40, are inserted through holes 8 of base member 2 and over the bag to tightly secure base member 2 and hence accessory 1 to golf bag 30. By this placement, indicator member 10 extends below base member 2, into golf bag 30. Golf club 32 can then be inserted into opening 20 of indicator member 10 and through the indicator member, such that the indicator member circumscribes the shaft of the golf club positioned within golf bag 30, as seen in FIG. 7.

Figure 8:
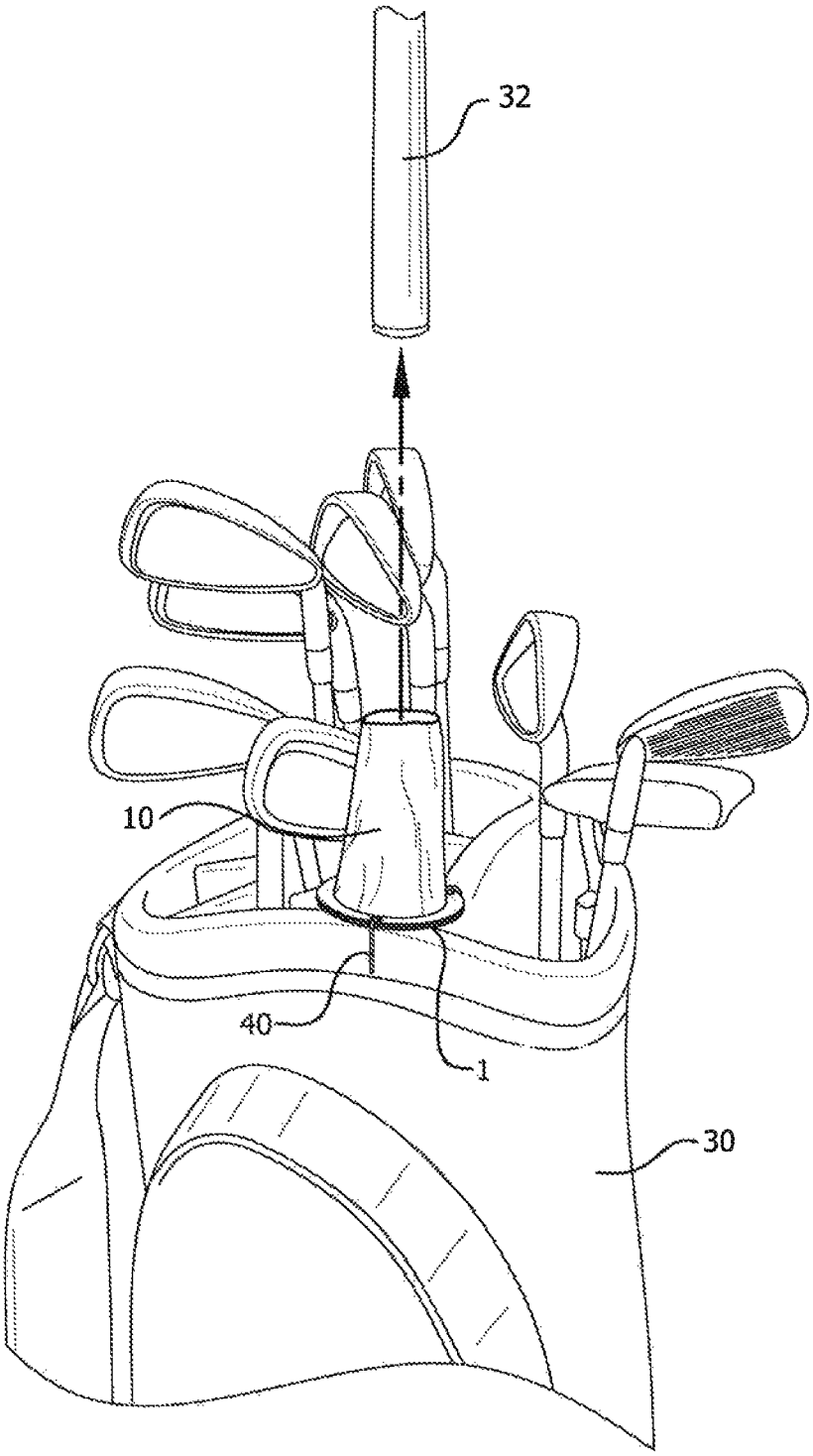
FIG. 8 shows the golf bag accessory of the present invention upon removal of a golf club from the golf bag.

When golf club 32 is removed from golf bag 30, the handle of the club passes through indicator member 10. The configuration and material of indicator member 10 causes it to be carried up along with the club's handle, as the club is lifted out of the bag. This results in indicator member 10 being extended substantially vertically up from base member 2, out of golf bag 30, when golf club 32 is completely withdrawn from the bag, as seen in FIG. 8. Clips 40 ensure that accessory 1 remains with golf bag 30. Since accessory 1 is now clearly extending up from golf bag 30, the golfer is provided clear and unmistakable notice that the withdrawn club is missing from his or her golf bag. Before moving on to the next hole, the golfer will be sure to replace golf club 32 in the golf bag.

Figure 9:
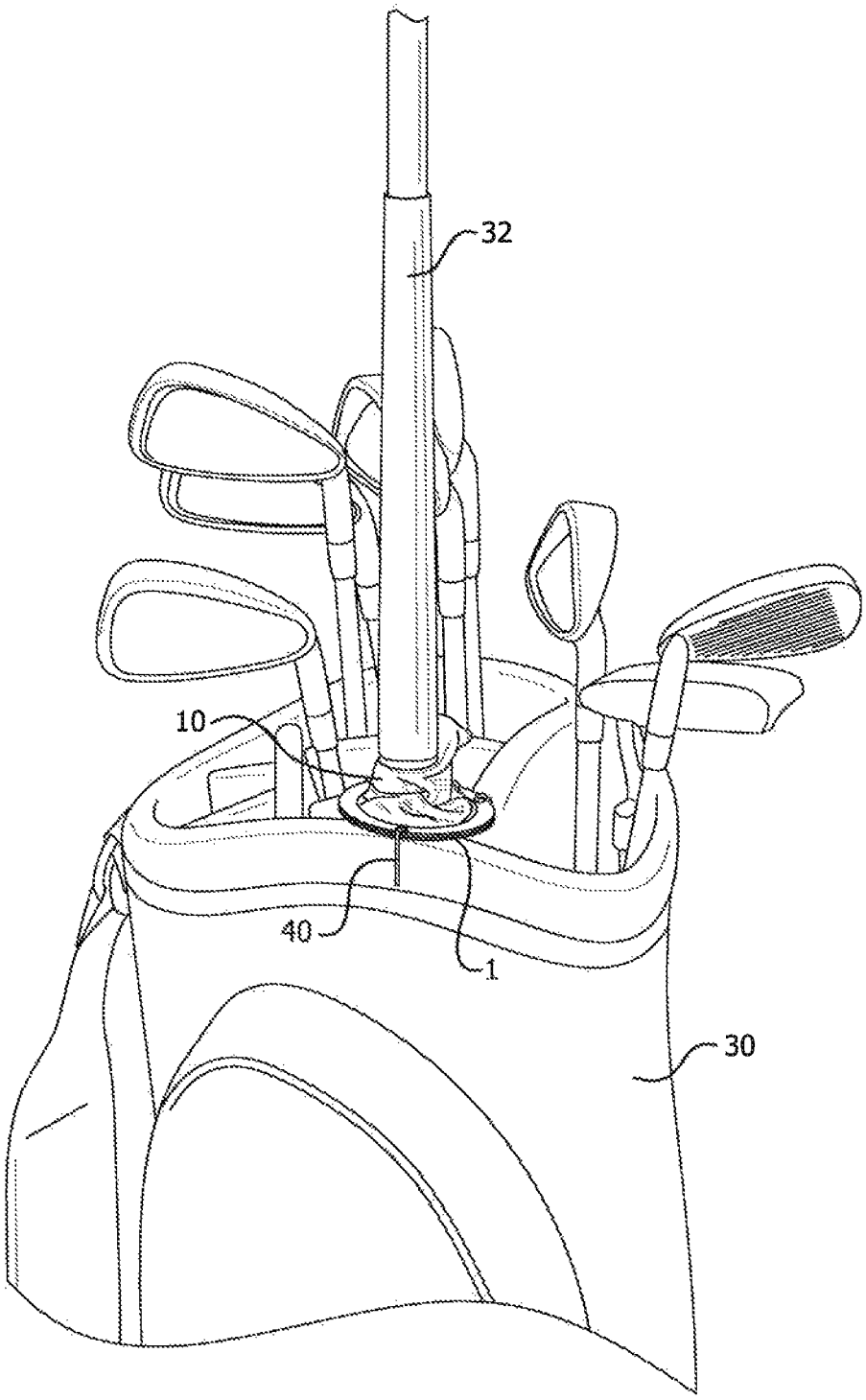
FIG. 9 shows the golf bag accessory of the present invention as a golf club is being inserted into the accessory, during replacement of the club into the golf bag.

Replacement of golf club 32, as shown in FIG. 9, merely requires that the club be inserted back into open end 20 of indicator member 10, and pushed through the indicator member, through opening 24 or opening 26 or pie slice shaped segments 28, into golf bag 30. Accessory 1 will then return to its original position, circumscribing club 32 within bag 30.

Golf bag accessory 1 thus provides the golfer with a portable, lightweight, device, readily installable on virtually any golf bag, which will ensure that clubs are never left behind and lost. The manner of attachment of accessory 1 also allows it to be easily removed and repositioned on the golf bag or attached to a different bag.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A golf bag accessory for indicating removal of a golf club from the golf bag, said accessory comprising:

a base member configured for placement on and connection to a top surface of a golf bag, said base member consisting of dual base member elements;

attachment means for connecting the base member elements to the golf bag; and an indicator member having a first end and a second end, said indicator member comprising a length of conically, frustum shaped flexible, low friction material secured between the dual base elements at the first end, the indicator member having a first opening at the first end and a second opening smaller than the first opening at the second end, said indicator member being configured to circumscribe a golf club positioned within the golf bag, whereby when the golf club is positioned within the golf bag, the indicator member is located within the golf bag, and upon removal of the golf club from the golf bag, the indicator member extends vertically up from the base member, completely out of the golf bag.

2. The golf bag accessory as in claim 1 wherein the indicator member comprises two layers of low friction material and a rubber boot element located between said layers.

3. The golf bag accessory as in claim 1 wherein the second end comprises pie slice shaped segments.

4. The golf bag accessory as in claim 1 wherein the attachment means comprises clips.

* * * * *